US005743709A

United States Patent [19]

Jane et al.

[11] Patent Number: 5,743,709

[45] Date of Patent: Apr. 28, 1998

[54] OSCILLATING WINDOW FAN

[75] Inventors: Rodney B. Jane, Westboro, Mass.; Jui-Shang Wang, Taipei, Taiwan; Robert L. Marvin, Jr., Farmington, Conn.; John Longan, Natick, Mass.

[73] Assignee: Honeywell Consumer Products, Inc., Southborough, Mass.

[21] Appl. No.: 458,145

[22] Filed: Jun. 1, 1995

[51] Int. Cl.[6] ..... F04D 29/70; F24F 7/013

[52] U.S. Cl. ..... 415/125; 416/100; 416/247 R; 454/200

[58] Field of Search ..... 416/100, 110, 416/247 R, 244 R, 246, 170 R; 454/208, 210, 200; 415/121.2, 125, 183, 185, 208.1, 208.2, 211.2, 213.1

[56] References Cited

U.S. PATENT DOCUMENTS

| | | | |
|---|---|---|---|
| Re. 34,334 | 8/1993 | Chaney | 454/210 |
| 1,713,946 | 5/1929 | Buckley | 415/125 |
| 2,661,895 | 12/1953 | Frick | 454/208 |
| 2,725,184 | 11/1955 | Mucci | 416/110 |
| 2,786,627 | 3/1957 | Hopper | 454/208 |
| 4,472,110 | 9/1984 | Sun Keu | 416/100 |
| 4,486,144 | 12/1984 | Hung | 416/247 R |
| 4,703,152 | 10/1987 | Shih-Chin | 416/110 |
| 5,382,136 | 1/1995 | Wang | 416/247 R |
| 5,411,371 | 5/1995 | Chen | 416/110 |
| 5,458,462 | 10/1995 | Shao | 416/247 R |

FOREIGN PATENT DOCUMENTS

| | | | |
|---|---|---|---|
| 0016288 | 1/1986 | Japan | 416/100 |
| 0016289 | 1/1986 | Japan | 416/100 |
| 0035094 | 2/1987 | Japan | 416/100 |
| 0127699 | 3/1950 | Sweden | 415/208.1 |
| 0629381 | 9/1949 | United Kingdom | 416/247 R |

*Primary Examiner*—Christopher Verdier
*Attorney, Agent, or Firm*—John E. Toupal; Harold G. Jarcho

[57] ABSTRACT

A portable electric window fan including a housing having side walls, a bottom wall for mounting on a sill of a window, a top wall for engaging a sash of the window, a front wall defining an air outlet, a rear wall defining an air inlet, and the walls together defining a closed chamber communicating with the inlet and outlet. Also included is a fan mount supported by the housing for rotation on a first axis; a drive shaft supported in the chamber on the fan mount and having a second axis transverse to the first axis; an electric drive motor coupled to the drive shaft and operable to produce rotation thereof; a fan blade fixed to the drive shaft for rotation therewith within the chamber; and an electrically powered drive mechanism coupled to the fan mount and operable to produce reciprocating rotation thereof on the first axis.

23 Claims, 4 Drawing Sheets

OSCILLATING WINDOW FAN

BACKGROUND OF THE INVENTION

This invention relates generally to a portable electric fan and, more particularly, to a portable electric oscillating window fan.

Portable electric fans are used extensively to reduce personal discomfort caused by excessive temperatures. Some portable electric fans are designed specifically for mounting in open windows of inhabited enclosures and are typically operable to either exhaust air from the enclosure or direct outside air thereinto. Although generally quite efficient for establishing desirable air circulation between inside and outside of a particular enclosure, prior window fans have failed to provide fully satisfactory air flow selectivity because of positional mounting limitations. For example, conventional window fans do not provide the variety of air flow distribution patterns furnished by portable floor or table fans that can function in a wider variety of positions.

In efforts to extend air circulation patterns, some prior fans have been provided with automatically movable frames. For example, U.S. Pat. No. 2,786,627 discloses a portable fan with an oscillating fan blade. However, such prior portable fans have not been capable of producing efficient air movement between opposite sides of an open window.

The object of this invention, therefore, is to provide an improved, more versatile portable window fan.

SUMMARY OF THE INVENTION

The invention is a portable electric window fan including a housing having side walls, a bottom wall for mounting on a sill of a window, a top wall for engaging a sash of the window, a front wall defining an air outlet, a rear wall defining an air inlet and the walls together defining a closed chamber communicating with the inlet and outlet. Also included is a fan mount supported by the housing for rotation on a first axis; a drive shaft supported in the chamber on the fan mount and having a second axis transverse to the first axis; an electric drive motor coupled to the drive shaft and operable to produce rotation thereof; a fan blade fixed to the drive shaft for rotation therewith within the chamber; and an electrically powered drive mechanism coupled to the fan mount and operable to produce reciprocating rotation thereof on the first axis. The housing provides efficient window mounted operation and the drive mechanism enhances air circulation patterns.

According to one feature of the invention, the drive mechanism includes a drive wheel rotatable on a third axis parallel to and spaced from the first axis and a drive arm having one end pivotally attached to the fan mount and an opposite end pivotally attached to a radially outer portion of the wheel. Desired reciprocating fan motion is established with this simple inexpensive structure.

According to other features of the invention, the electric motor is supported by the fan mount, the first axis is substantially vertical and the second axis is substantially horizontal. These features reduce construction expense and provide desirable operational capabilities.

In one embodiment of the invention, the drive mechanism includes a gear assembly coupled to the drive shaft. The gear assembly provides desired reciprocating fan motion without significant added cost.

In another embodiment of the invention, the drive mechanism comprises an auxiliary motor. Additional operational flexibility is provided by the auxiliary motor.

According to still another feature of the invention, the fan includes a wing wall extendable out of each of its side walls. The wing walls facilitate air movement through an open window.

According to yet other features of the invention, the front wall has a vertically cylindrical portion defining the outlet and aligned with the fan blade which has a given diameter, the cylindrical portion has a horizontal width substantially corresponding to the given diameter, and the front wall further includes a connecting portion of substantial horizontal width joining each opposite side of the cylindrical portion to a different one of the side walls. The enlarged cylindrical housing portion provides an efficient structure for accommodating oscillatory fan movement.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENTS

Figure 1:
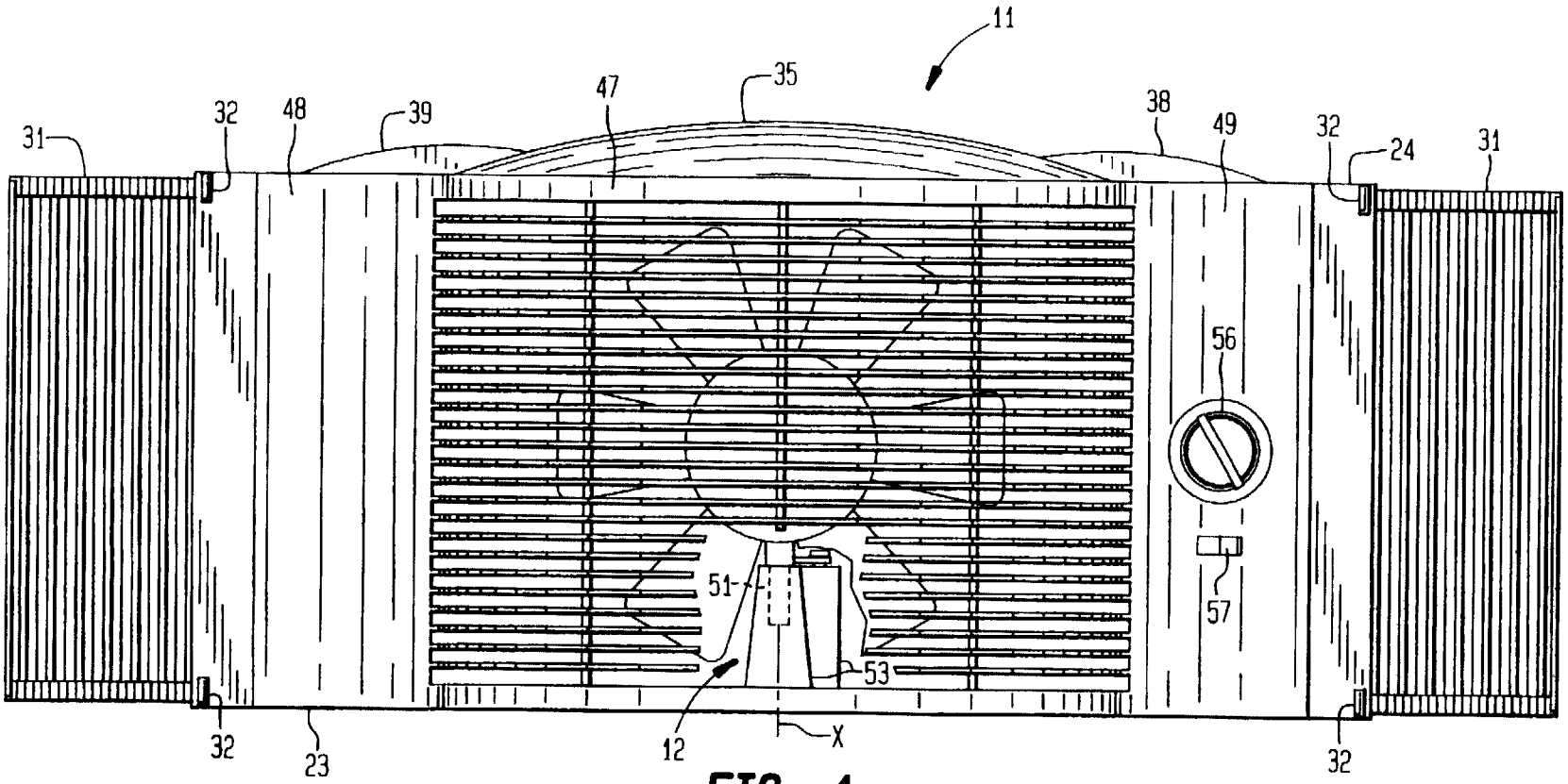
FIG. 1 is a partially cut away front elevational view of a window fan according to the invention.

A window fan 11 includes a fan mount 12 supported for rotation on a first axis X (FIG. 1) within a closed chamber 14 formed by a housing 15. Also included with the window fan 11 and retained within the chamber 14 is an electric motor 17 operatively coupled to an air director fan blade 18 by a horizontal drive shaft 19 having a second axis Y transverse to the first axis. Reciprocating rotational movement of the fan mount 12 on the first axis X is produced by a drive mechanism 21 also included with the window fan 11 and retained within the chamber 14.

The fan housing 15 is formed by a bottom wall 23, a top wall 24, a pair of side walls 25, 26, a front wall 27 and a rear wall 28. Projecting out of each of the side walls 25, 26 is an extendable wing wall 31 retained by releaseable latch members 32. The top wall 24 has a semi-spherical portion 35 forming a vertical, rearwardly facing surface 36. Spaced from the surface 36 and extending upwardly from the top wall 24 are a pair of flanges 38, 39.

The rear wall 28 defines an air inlet 41 covered by a grill 42. Aligned with the air inlet 41 and the fan blade 18 is an air outlet 44 in the front wall 27. Covering the air outlet 44 is a grill 45. The air outlet 44 is formed by a vertically cylindrical front wall portion 47 which has a horizontal width substantially corresponding to the diameter of the fan blade 18. Joining opposite vertical sides of the cylindrical portion 47, to, respectively, the side walls 25, 26 are connecting portions 48, 49 of the front wall 27. Preferably, the connecting portions 48, 49 have a combined width equal to at least one-half the diameter of the fan blade 18.

Figure 3:
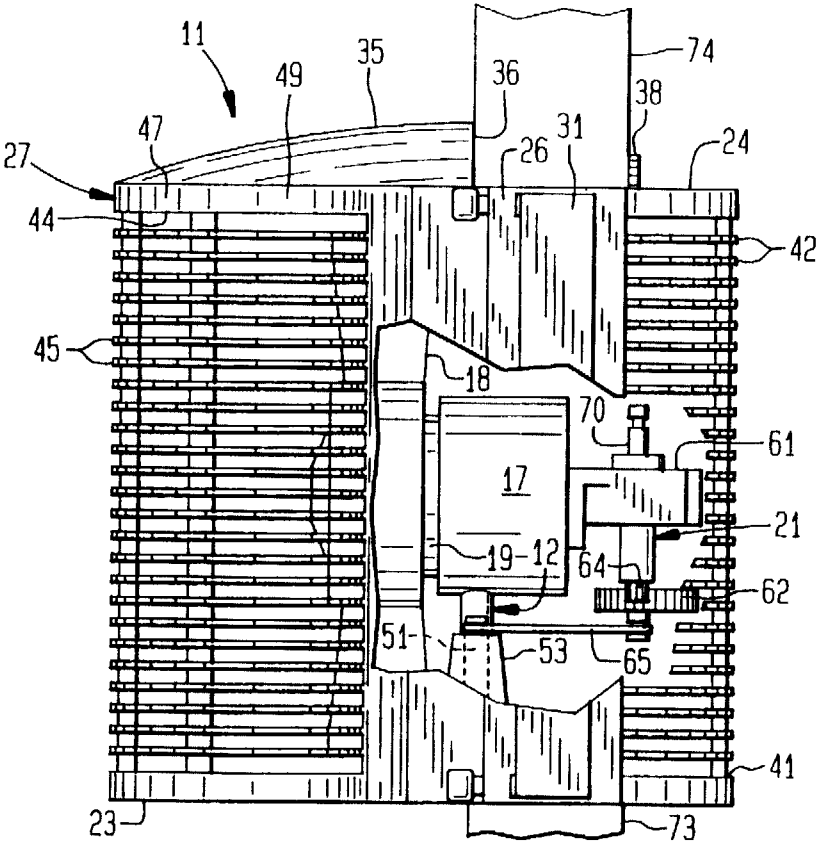
FIG. 3 is a partially cut away right side view of the fan shown in FIG. 1.

As shown in FIGS. 1 and 3, the fan mount 12 includes a vertical shaft 51 rotatably received within a cylindrical recess in a boss 53 extending upwardly from the bottom wall 23 of the housing 15. Supported by the fan mount 12 is an electric motor 17 operatively coupled to the drive shaft 19.

The motor 17 is controlled by a switch knob 56 disposed on the connecting portion 49 of the front wall 27 (FIG. 1). Also disposed on the connecting portion 49 is a signal lamp 57 for indicating an operating condition of the fan 11.

Figure 2:
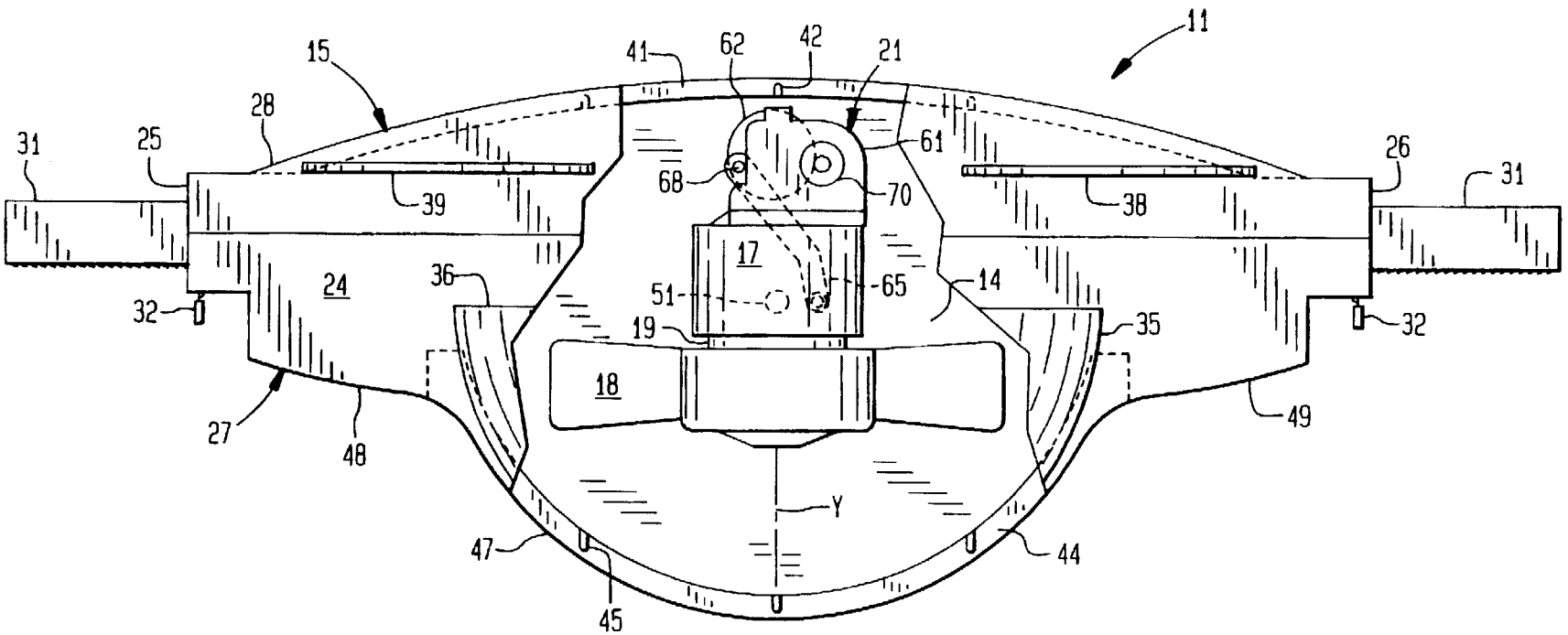
FIG. 2 is a partially cut away top view of the fan shown in FIG. 1.

The drive mechanism 21 includes a gear box 61 (FIG. 3) supported by the motor 17 and having conventional gears (not shown) such as conventional bevel gears coupling the drive shaft 19 to a planetary gear 64. Also included with the drive mechanism 21 are a drive gear wheel 62, and a drive arm 65 extending between the drive wheel 62, and the fan mount 12. The drive wheel gear 62 is engaged with the planetary gear 64 so as to be rotatable thereby in response to rotation of the drive shaft 19. As shown in FIG. 2, the drive arm 65 has one end pivotally connected to a radially outer portion 68 of the drive wheel 62 and an opposite end pivotally attached to the boss 53 at a point horizontally spaced from the fan mount shaft 51. A plunger 70 can be manually operated to decouple the drive shaft 19 from the planetary gear 64 thereby terminating rotation of the drive gear wheel 62.

Prior to use, the bottom wall 23 of the window fan is mounted on a sill 73 (FIG. 3) of an opened window and a sash 74 is lowered into engagement with the top wall 24 between the vertical surface 36 and the flanges 38, 39. After release of the latch members 32, the wing walls 31 are extended from the side walls 25, 26 into engagement with side surfaces of the open window. Actuation of the control knob 56 then will energize the motor 17 to produce rotation of the drive shaft 19 and fan blade 18 to induce movement of air in through the inlet 41 and out of the outlet 44.

Rotation of the drive shaft 19 also produces rotation of the drive gear wheel 62 (FIG. 3) via the planetary gear 64 and the coupling gears in the gear box 61. The rotation of the drive wheel 62 alternately pushes and pulls on the drive arm 65 causing reciprocating rotation of the fan mount 12 on the mounting boss 53. Thus, the fan motor 17 and fan blade 18 horizontally oscillate within the clearance provided in the chamber 14 defined by the cylindrical portion 47 of the front wall 27. As shown in FIG. 2, an apex of the cylindrical portion 47 is aligned with a center of the fan blade 18 and is displaced therefrom by a distance greater than one-quarter the diameter thereof so as to accommodate substantial oscillatory movement of the fan blade 18.

Figure 4:
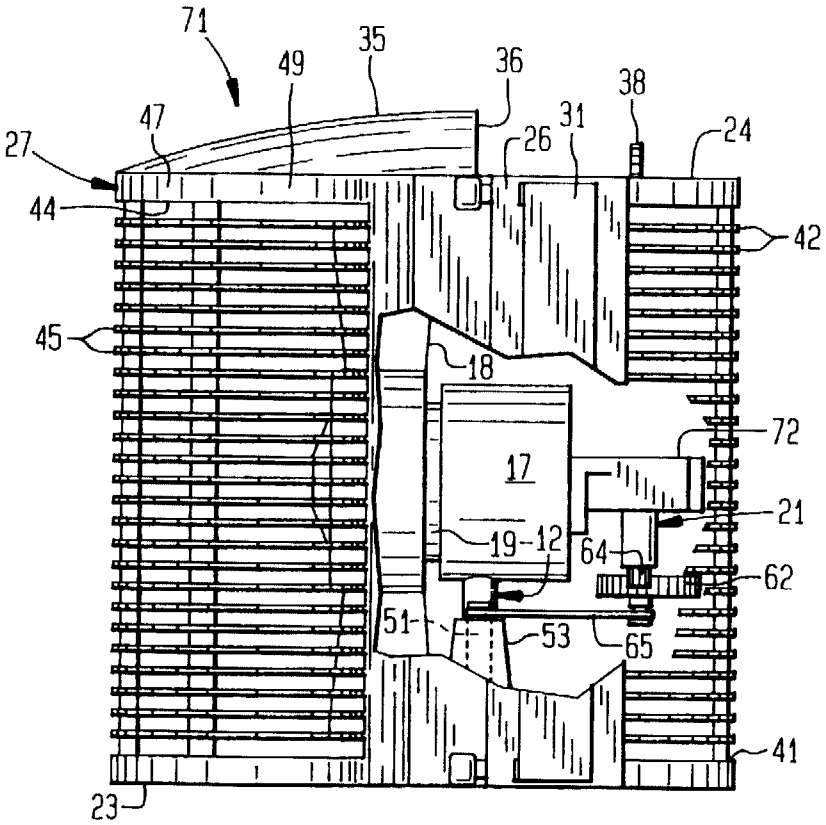
FIG. 4 is a partially cut away side view of another window fan embodiment according to the invention.

Another window fan embodiment 71 of the invention is shown in FIG. 4. Components of the embodiment 71 identical to those of the embodiment 11 have been given the same reference numerals. In the embodiment 71, the gear box 61 of the embodiment 11 is replaced by an auxiliary electrical motor 72 which is supported by the fan motor 17 and operatively coupled to the planetary gear 64. During use of the embodiment 71, the fan motor 17 and auxiliary motor 72 can be independently energized to produce either unidirectional airflow with the fan mount 12 in a stationary mode and the auxiliary motor 72 deenergized or multiple directional air flow in an oscillating mode with the fan mount 12 oscillating in response to energization of the auxiliary motor 72.

Obviously, many modifications and variations of the present invention are possible in light of the above teachings. It is to be understood, therefore, that the invention can be practiced otherwise than as specifically described.

What is claimed is:

1. A portable electric window fan comprising:

a housing having side walls, a bottom wall for mounting on a sill of a window, a top wall for engaging a sash of the window, a front wall defining an air outlet, a rear wall defining an air inlet; said housing defining a closed chamber communicating with said inlet and said outlet;

a fan mount supported by said housing;

a fan blade rotatably mounted on said fan mount and disposed within said closed chamber, said fan blade being arranged to direct air flow into said air inlet and out of said air outlet;

an electric drive motor rotatably coupled to said fan blade; and an electrically powered drive mechanism coupled to said fan mount and arranged to produce substantial oscillating movement of said fan blade, and wherein said closed chamber is shaped and arranged to provide clearance that accommodates said substantial oscillating movement of said fan blade.

2. A fan according to claim 1 wherein said front wall comprises a vertically cylindrical portion defining said outlet, axially aligned with said fan blade and providing clearance for accommodating said substantial oscillating movement of said fan blade.

3. A fan according to claim 2 wherein said cylindrical portion has a horizontal width substantially equal to a diameter of said fan blade and an apex aligned with a center of said fan blade and displaced therefrom by a distance at least ¼ said diameter thereof so as to accommodate said substantial oscillating movement of said fan blade.

4. A fan according to claim 1 wherein said top wall defines spaced apart surfaces for straddling the sash.

5. A fan according to claim 4 including a wing wall extendable out of at least one of said side walls.

6. A fan according to claim 5 wherein said fan mount is supported for rotation on a first axis, and including a drive shaft supported in said chamber on said fan mount and having a second axis transverse to said first axis.

7. A fan according to claim 6 wherein said drive mechanism comprises a drive wheel rotatable on a third axis parallel to and spaced from said first axis, and a drive arm having one end pivotally attached to said fan mount and an opposite end pivotally attached to a radially outer portion of said wheel.

8. A fan according to claim 7 wherein said electric motor is supported by said fan mount.

9. A fan according to claim 6 wherein said first axis is substantially vertical and said second axis is substantially horizontal.

10. A fan according to claim 9 wherein said drive mechanism comprises a drive wheel rotatable on a third axis parallel to and spaced from said first axis, and a drive arm having one end pivotally attached to said fan mount and an opposite end pivotally attached to a radially outer portion of said wheel.

11. A fan according to claim 10 wherein said electric motor is supported by said fan mount.

12. A fan according to claim 6 wherein said drive mechanism comprises an auxiliary motor.

13. A fan according to claim 12 wherein said drive mechanism comprises a drive wheel rotatable on a third axis parallel to and spaced from said first axis, and a drive arm having one end pivotally attached to said fan mount and an opposite end pivotally attached to a radially outer portion of said wheel.

14. A fan according to claim 13 wherein said drive motor and said auxiliary motor are supported by said fan mount.

15. A fan according to claim 5 including a wing wall extendable out of each of said side walls.

16. A fan according to claim 6 wherein said front wall comprises a vertically cylindrical portion defining said outlet and aligned with said fan blade.

17. A fan according to claim 16 wherein said fan blade has a given diameter, said cylindrical portion has a horizontal width substantially corresponding to said given diameter, and said front wall further comprises a connecting portion of substantial horizontal width joining each opposite side of said cylindrical portion to a different one of said side walls.

18. A fan according to claim 17 wherein said drive mechanism comprises a drive wheel rotatable on a third axis parallel to and spaced from said first axis, and a drive arm having one end pivotally attached to said fan mount and an opposite end pivotally attached to a radially outer portion of said wheel.

19. A fan according to claim 17 wherein said first axis is substantially vertical and said second axis is substantially horizontal.

20. A fan according to claim 17 wherein said drive mechanism comprises a gear assembly coupled to said drive shaft.

21. A fan according to claim 17 wherein said drive mechanism comprises an auxiliary motor.

22. A fan according to claim 17 including a wing wall extendable out of each of said side walls.

23. A fan according to claim 17 wherein said connecting portions have a combined horizontal width equal to at least one-half said given diameter.

* * * * *